US005242087A

United States Patent [19]

Keldenich et al.

[11] Patent Number: 5,242,087

[45] Date of Patent: Sep. 7, 1993

[54] COMBINATION AEROSAL CAN AND CAP PLACED ON SAID AEROSOL CAN

[75] Inventors: Jacques E. Keldenich, Etten-Leur; Petrus W. C. Clijsen, Berkel-Enschot, both of Netherlands

[73] Assignee: Plasticum B.V., Tilburg, Netherlands

[21] Appl. No.: 846,945

[22] Filed: Mar. 6, 1992

[30] Foreign Application Priority Data

Mar. 7, 1991 [NL] Netherlands ..... 9100406

[51] Int. Cl.[5] ..... B67D 5/32

[52] U.S. Cl. ..... 222/153; 222/402.11; 222/402.13; 222/635

[58] Field of Search ..... 222/153, 402.1, 402.11, 222/402.13, 635

[56] References Cited

U.S. PATENT DOCUMENTS

| | | | |
|---|---|---|---|
| 3,744,682 | 7/1973 | Blank | 222/402.11 |
| 3,788,523 | 11/1974 | Thomas | 222/153 |
| 4,424,920 | 1/1984 | Tada | 222/153 X |
| 4,442,955 | 4/1984 | Bush | 222/402.13 X |

*Primary Examiner*—Andres Kashnikow
*Assistant Examiner*—J. A. Kaufman
*Attorney, Agent, or Firm*—Oblon, Spivak, McClelland, Maier & Neustadt

[57] ABSTRACT

A combination wherein the cap is provided with a shell which engages under a collar located near the upper side of the aerosol can by the provision of at least one locking lip located near the open bottom end of the shell. An operating arm is coupled to the shell so that a valve, forming part of the aerosol can, can be actuated so as to discharge the contents of the aerosol can. At the inner side of the shell a wing is secured to a part of the shell which can be pressed inwardly with respect to the other parts of the shell, the wing, at its side remote from the shell abutting against a part of the aerosol can and in the unloaded condition of the part of the shell, carrying the wing cooperating with the operating arm so as to prevent the operating arm from moving so as to open the valve. The construction is such that when the part of the shell carrying the wing is depressed the end of the wing abutting against a part of the aerosol can will be pivoted, and move along this part of the aerosol can, about a pivot axis extending at least substantially parallel to the central axis of the aerosol can, into a position in which the wing allows a pivoting motion of the operating arm and spraying of the aerosol can.

6 Claims, 5 Drawing Sheets

COMBINATION AEROSAL CAN AND CAP PLACED ON SAID AEROSOL CAN

BACKGROUND OF THE INVENTION

1. Field of the Invention

The invention relates to a combination of an aerosol can and a cap placed on said aerosol can, said cap being provided with a shell, which engages under a collar located near the upper side of the aerosol can by means of at least one locking lip located near the open bottom end of said shell, while an operating arm is coupled to the shell, by means of which a valve, forming part of the aerosol can, can be actuated so as to discharge the contents of the aerosol can. p 2. Discussion of the Background Such combinations of aerosol cans and caps are generally known. It is true that with such a combination it is difficult to remove the cap from the aerosol can, especially for children, but the aerosol can can be used without impediment for discharging the contents of the aerosol can by actuating the operating arm. In view of the contents of the aerosol can, however, it is often desirable to prevent as much as possible the unpermitted use of the aerosol can, in particular by children.

SUMMARY OF THE INVENTION

According to the invention this can be achieved by the fact that at the inner side of the shell a wing is secured to a part of the shell which can be pressed inwards with respect to the other part of the shell. The wing at a side there of remote from the shell abutts against a part of the aerosol can and in the unloaded condition of the part of the shell carry the wing cooperating with the operating arm, so as to prevent the operating arm from moving so as to open the valve. The construction is such that when the part of the shell carrying the wing is depressed, the end of the wing abutting against a part of the aerosol will be pivoted, while moving along this part of the aerosol can, about a pivot axis extending at least substantially parallel to the central axis of the aerosol can, into a position in which the wing allows a pivoting motion of the operating arm.

When using such a combination of an aerosol can and a cap placed on the aerosol can it is therefore not only necessary to actuate the operating arm in order to discharge the contents of the aerosol can, but also to exert a force on a certain part of the shell of the cap carrying the wing, so as to make it possible for the operating arm to move and thus for the valve of the aerosol can to open. In this manner it is possible with the construction according to the invention to achieve a combination of an aerosol can and a cap placed on the aerosol can which is in particular protected from unqualified use by children, while yet retaining a comparatively simple construction of the cap.

BRIEF DESCRIPTION OF THE DRAWINGS

The invention will now be explained in more detail hereafter with reference to an embodiment of the construction according to the invention illustrated in the accompanying Figures.

DESCRIPTION OF THE PREFERRED EMBODIMENT

Figure 2:
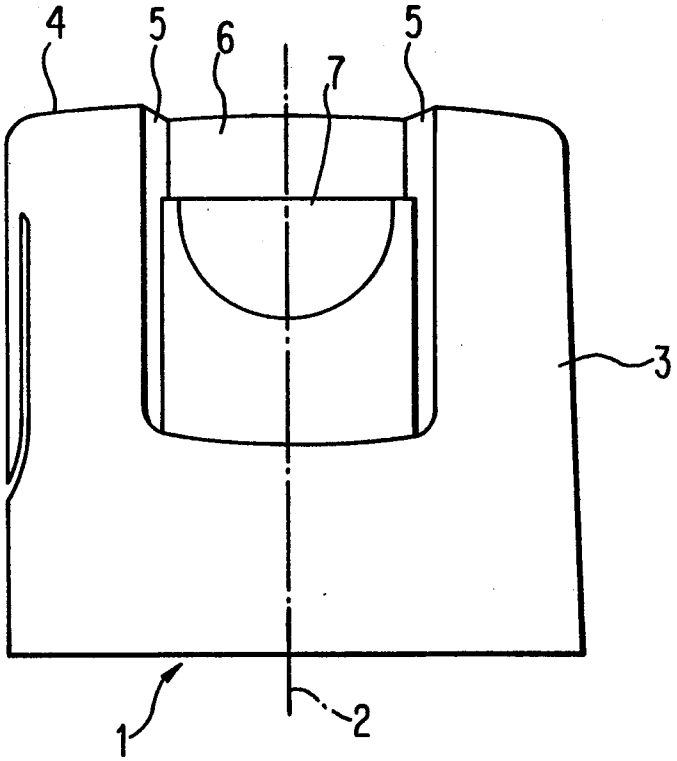
FIG. 2 is a side view of FIG. 1, seen according to the arrow II in FIG. 1.

The cap 1 for an aerosol can shown in the Figures is provided in the usual manner with a shell 3 which extends concentrically about the central axis 2 of the cap, an upper wall 4 joining the upper end of said shell.

An at least substantially U-shaped recess is provided in the upper wall, while a U-shaped boundary wall, which extends downwards from the upper wall 4, joins the edges of said recess, said boundary wall including two legs 5, extending at least substantially parallel to each other, and a connecting piece 6 connecting said two legs 5. The ends of the legs 5 remote from the connecting piece 6 join the shell 3 near a recess formed in the shell. As furthermore appears in particular from FIG. 5 the U-shaped wall 5, 6 extends downwards from the upper wall 4, along substantially less than half the height of the cap, while an operating lever is located in a U-shaped recess bounded by said wall 5, 6, said recess being open at one side of the cap. The operating lever is integral with the other parts of the cap, which is made of plastic material, and is thereby connected to the bottom end of the connecting piece 6 with a connecting rib 8 forming a hinge.

In the illustrated embodiment the operating lever 7 has an at least substantially U-shaped section, while the operating lever 7 furthermore has a hole 9 for accommodating the discharge part of the valve of an aerosol can.

Figure 6:
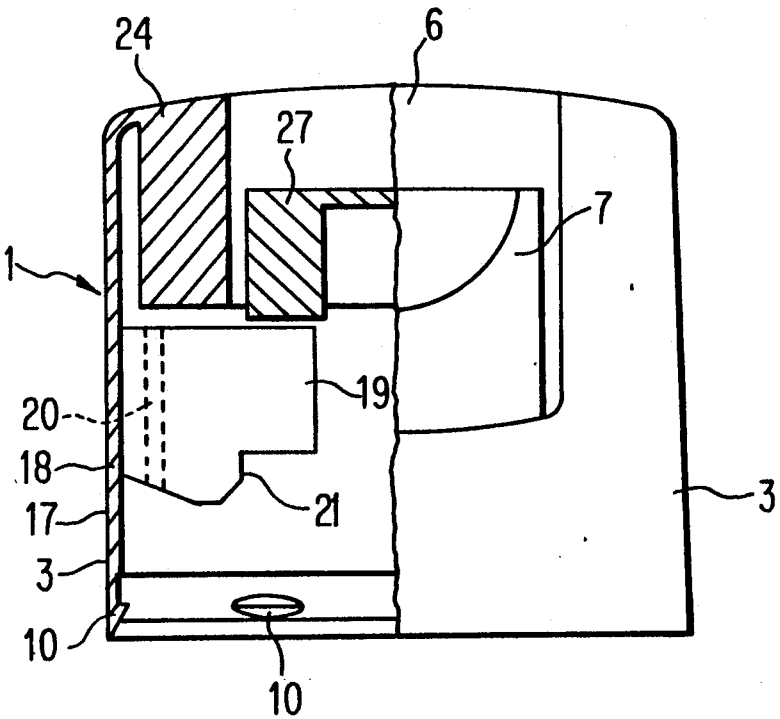
FIG. 6 is a sectional view of FIG. 4, along the line VI—VI in FIG. 4.
Figure 5:
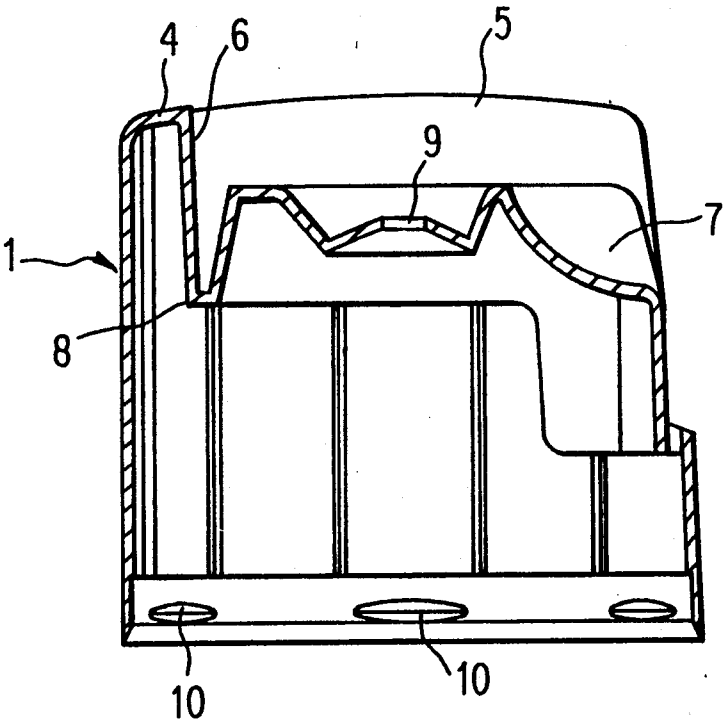
FIG. 5 is a sectional view of FIG. 3, taken along line V—V in FIG. 3.

As furthermore appears in particular from FIGS. 5 and 6, the bottom end of the shell 3 of the cap is thinner than the other part of the cap 1, while a plurality of inwardly extending locking lips 10 are provided on the inner circumference of said bottom end.

Figure 10:
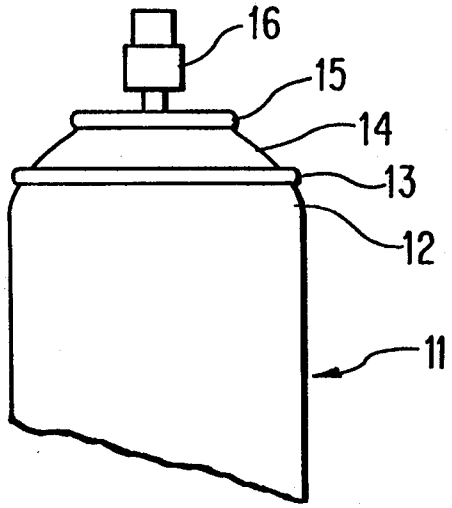
FIG. 10 diagrammatically shows the upper end of an aerosol can.
Figure 9:
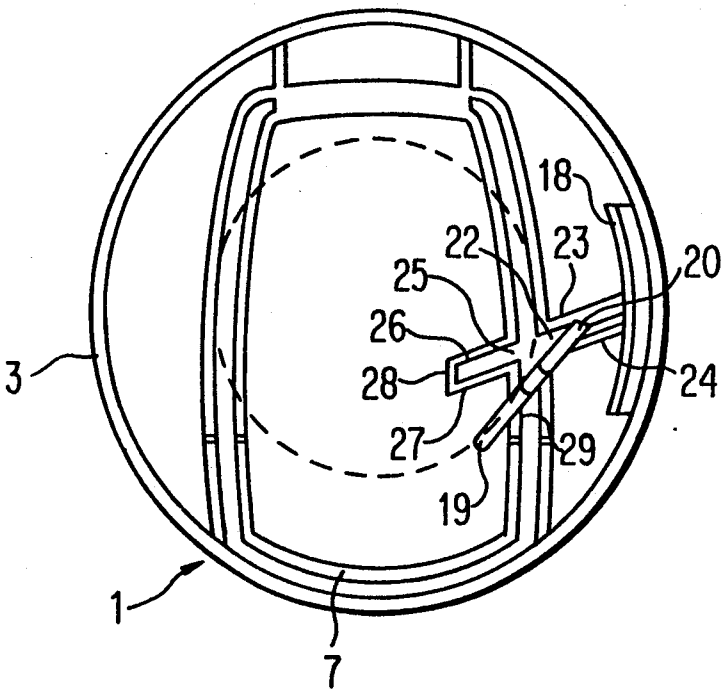

The cap described above is suitable for being mounted on an aerosol can 11 of the type shown in FIG. 10. Such an aerosol can usually has a curled portion 13 at the upper end of its cylindrical shell 12, which forms the attachment between the upper end of the shell 12 and a more or less dome-shaped cover 14 closing the aerosol can at its upper end. Usually a valve mechanism 16 is mounted on the upper end of said dome-shaped cover 14 by means of a curled collar 15, via which valve mechanism the contents of the aerosol can can be discharged.

The above-discussed cap may be placed on the upper end of the aerosol can 11, whereby the locking lips 10 snap under the curled portion 13, thus providing a secure attachment of the cap on the aerosol can 11. The upper end of the valve mechanism 16 will thereby come to lie in the hole 9 of the operating lever 7. When a downwardly directed pressure is exerted on the end of the operating lever 7 remote from the connecting rib 8 of the operating lever 7, the valve mechanism 16 will be opened and the contents of the aerosol can 11 can spray out of the aerosol can via the valve mechanism.

From the foregoing, a preferred embodiment of the operating lever and the valve mechanism to be actuated by means of the operating lever is understandable and illustrated in the Figures, but it will be apparent for those skilled in the art that also other embodiments of operating levers and valve mechanisms matched for each other may be used.

Figure 1:
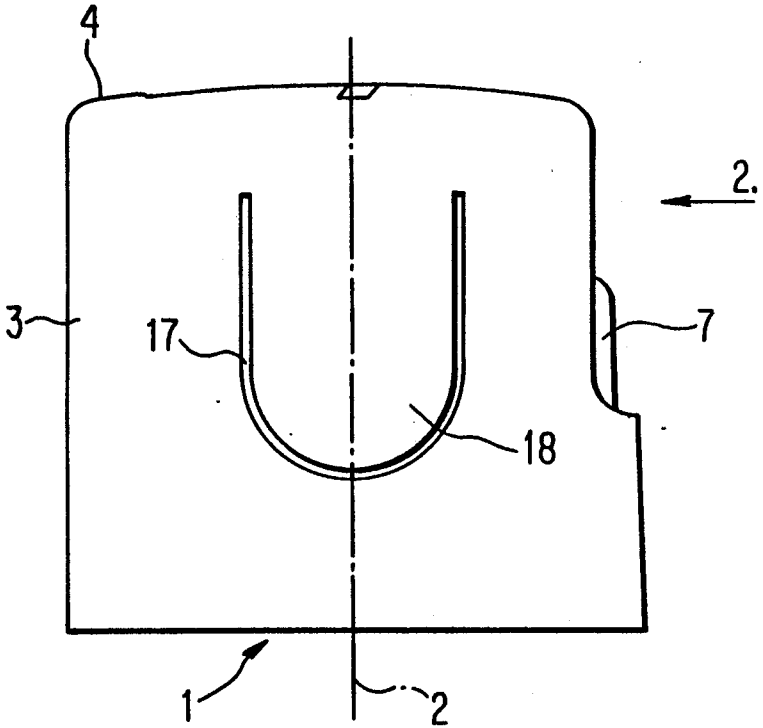
FIG. 1 is a side view of a cap for an aerosol can according to the invention.

As appears in particular from FIG. 1 a U-shaped gap 17 is provided in a part of the shell 3 of the cap extending at least substantially parallel to the wall parts 5 of the recess accommodating the operating lever 7, so that a lip 18 is formed in the shell 3 of the cap 1, which is only connected to the remaining part of the shell 3 near its upper end. In the interior of the cap one end of a wing 19 is secured to the lip 18. Said wing 19 extends parallel to a plane extending through the central axis 2 of the cap. The end of the wing 19 joining the lip 18 is thereby secured to the lip near the center of the lip. At a short distance from the connection of the wing 19 to the lip 18 a groove 20, which extends parallel to the central axis 2 of the cap, is formed in the wing. The lower boundary edge of the wing 19 is profiled, in such a manner that the part of the wing joining the lip 18 projects under the free end of the lip and thus a stop shoulder 21 located some distance from the free end of the wing 19 and extending parallel to the central axis 2 of the cap is formed, for a purpose to be described in greater detail hereafter.

As furthermore appears from FIGS. 4 and 7–9 a slot 22, extending parallel to the central axis of the cap, is formed in the wall part 5 located closest to the lip 18. Two wall parts 23 and 24, extending parallel to each other, join the boundary edges of said slot 22, said wall parts extending from the wall part 5 in the direction of the lip 18. Near the slot 22 a similar slot 25 (FIG. 9) is provided in the side wall of the operating lever 7 extending parallel to the wall part 5. Wall parts 26 and 27 extending in line with the wall parts 23 and 24 join the boundary edges of said slot 25, said wall parts 26 and 27 extending from the boundary edges of the slot 25 in a direction remote from the wall parts 23 and 24 and being interconnected by a connecting rib 28 at their ends remote from the slot 25.

Figure 4:
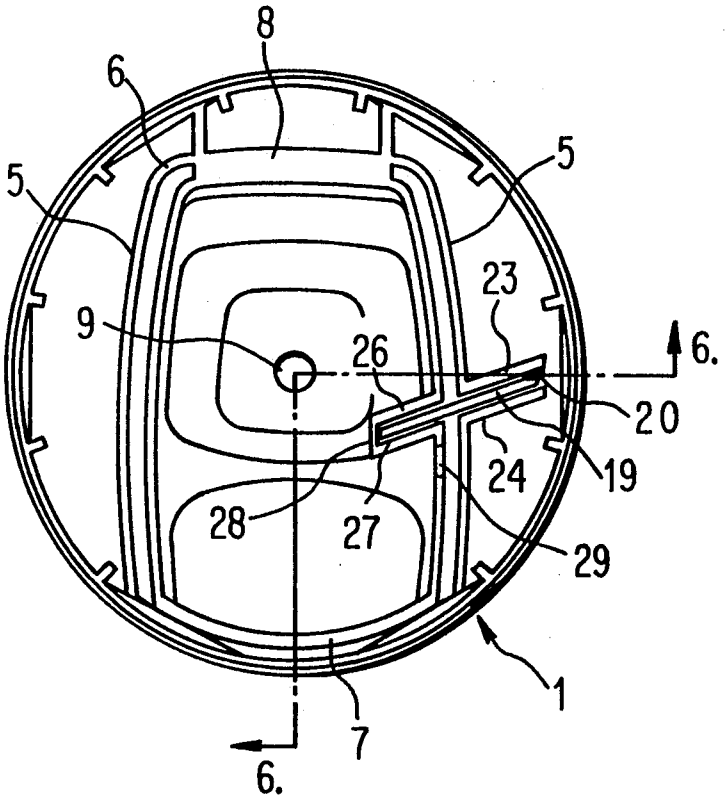
FIG. 4 is a bottom view of the cap shown in FIGS. 1 and 2.
Figure 3:
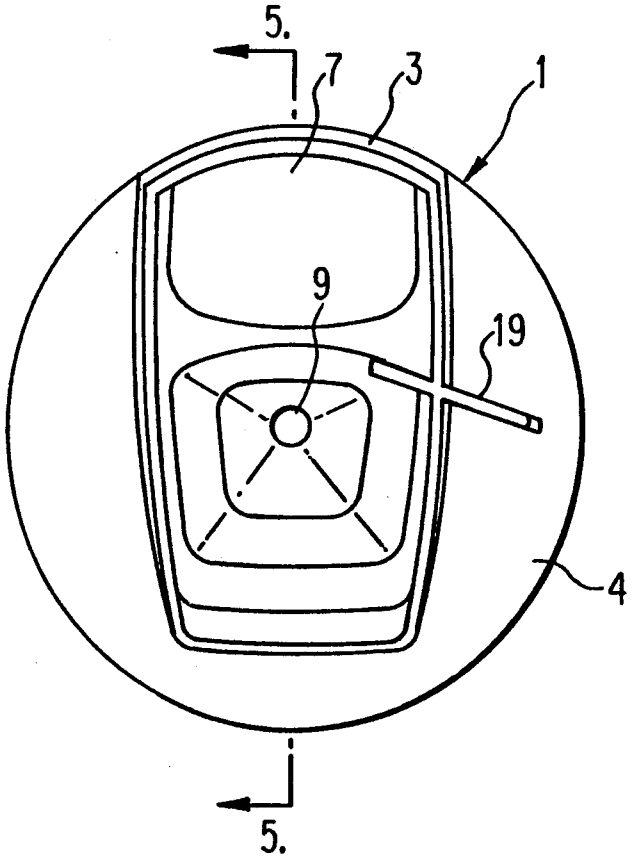
FIG. 3 is a top plan view of the cap shown in FIGS. 1 and 2.
Figure 7:
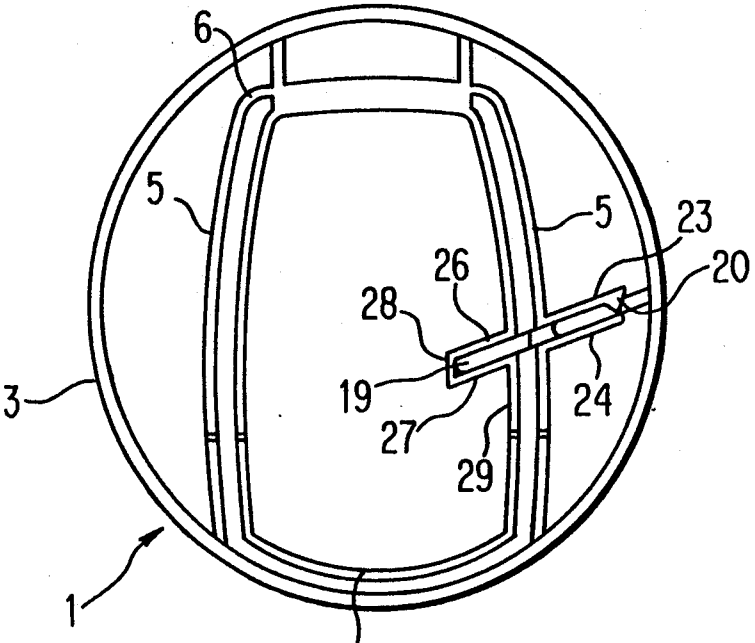

As appears in particular from FIGS. 4 and 7, in the unloaded condition the wing 19 is positioned in line with the slot bounded by the wall parts 23, 24 and 26, 27 and, as appears from FIG. 6, under the lower boundary edges of the operating arm 7 located near the wing 19 and the wall parts 23, 24, 26 and 27 in question. As a result of this construction it is possible to fabricate the above-described cap illustrated in the Figures in one piece in a mold, e.g. by injection moulding, from plastic material, so that a fast production of the cap can be ensured, no separate parts need to be attached to the cap and thus no parts of the cap can be lost.

As is also apparent from the Figures thereby, the wing 19 includes an acute angle with the plane extending through the central axis 2 of the cap and the connecting point of the wing to the lip 18.

Figure 8:
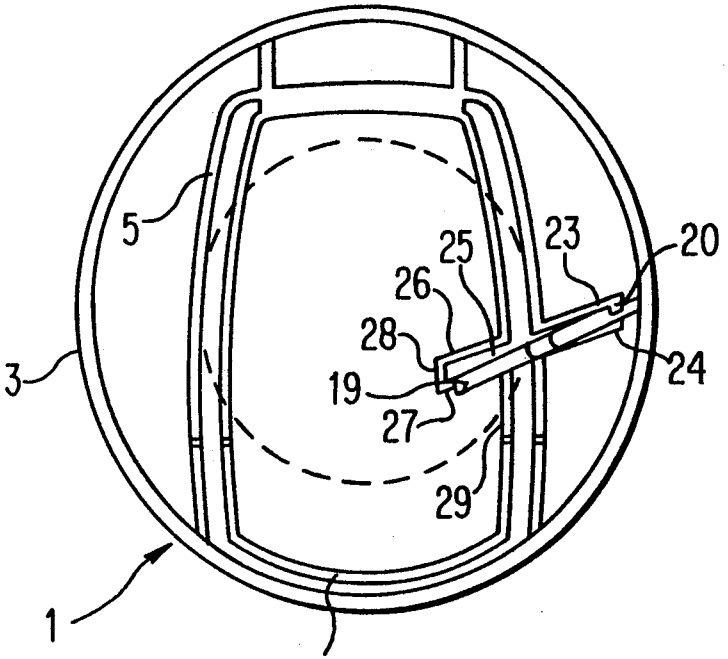
FIGS. 7-9 are diagrammatic bottom views of the cap, illustrating various positions of the wing, which is connected to the movable part of the shell.

When the cap is placed in the usual manner on the upper end of an aerosol can of e.g. the type shown in FIG. 10, the stop shoulder 21 of the wing will come into contact with the outer circumference of the curled collar 15, as a result of which the wing 19 will be pushed from the position shown in FIGS. 4 and 7 into the position shown in FIG. 8, in which the upper boundary edge 19 of the wing will come to lie beside the gap bounded by the wall parts 26 and 27, just below the lower edge of the operating lever 7, as is shown in FIG. 6. In this position the wing 19 prevents the lever 7 from being depressed so as to actuate the valve mechanism 16.

When an inwardly directed force is exerted on the lip 18 near the outer side of the cap 1, the lip 18 will pivot with respect to the other part of the cap 1, about an imaginary pivot axis located near the connecting line between the upper ends (when seen in FIG. 1) of the legs of the gap 17. When the lip 18 is pressed inwardly in this manner the stop shoulder 21 of the wing 19 is forced to move along the outer circumference of the curled collar 15, as a result of which the wing 19 will pivot about an imaginary pivot axis located near the groove 20 formed in the wing 19, from the position shown in FIG. 8 to the position shown in FIG. 9. In this position of the wing 19 shown in FIG. 9 the wing 19 is located near a recess 29, which is provided in the side wall of the operating lever 7 located above the wing. In this position the operating lever 7 can be pivoted downwards so as to actuate the valve mechanism 16, whereby the upper end of the wing 19 is received in the recess 29 of the operating lever. It will be apparent that instead of providing a recess 29 in the operating lever 7 it will also be possible to provide a recess in the upper part of the wing 19, whereby the side wall of the operating lever 7 will be received in said recess when the operating lever 7 is pressed down.

When the operating lever 7 is released again it will pivot back into its starting position in a usual manner. When the lip 18 is released as well it will pivot back as a result of the inherent resilience of the material of which the cap is made, as a result of which also the wing 19 will return to the position of said wing shown in FIG. 8, and thus the operating lever 7 is again locked against being pivoted downwards.

In order to operate the aerosol can it is therefore necessary first to press the actuating lip 18 inwards with respect to the other part of the cap and then to depress the operating lever 7. The selected arrangement of the parts makes it possible to carry this out with one hand, actuating the lip 18 with the thumb and the operating lever with the index finger.

By using the construction according to the invention a closure mechanism for an aerosol can which is at least safe for children can be realized by means of a cap placed on the aerosol can, while it is also possible to make such cap in one piece.

We claim:

1. A safety device for an aerosol can with a valve, which comprises:

a cap for being placed on said aerosol can, said cap including a shell having at least one locking lip located near an open bottom end of the shell for engaging an upper collar portion of the aerosol can;

an operating lever pivotally connected to the shell by which the valve of the aerosol can is actuated so as to discharge the contents of the aerosol can;

a wing secured to the interior of the shell for being inwardly depressed with respect to a remainder of the shell, wherein said wing at a side thereof remote from the shell abuts against an upper part of the aerosol can while, in an unloaded condition of a part of the shell carrying the wing, the wing cooperates with the operating lever so as to prevent the operating lever from engaging and operating the valve of the aerosol can wherein upon the part of the shell carrying the wing being inwardly depressed, the side of the wing abutting the upper part of the aerosol can is pivoted with respect to the shell, and is moved along said upper part of the aerosol can about a pivot axis extending at least substantially parallel to the central axis of the aerosol can into a position in which the wing permits pivoting motion of the operating lever by an operator.

2. A combination according to claim 1, wherein the cap is integral with the operating lever and the wing and the cap has two wall parts which extend parallel to the wing and wherein, in an unloaded condition of the part of the shell carrying the wing, the wing is located between said two wall parts.

3. A combination according to claim 1, wherein in unloaded condition the wing is located between two wall parts connected to the shell and extending parallel to the wing, said wall parts extending from a wall of the shell in the direction of the part of the shell carrying the wing.

4. A combination according to claim 1, wherein in the wing, at a point of connection of the wing to the shell, a groove is provided which extends at least substantially parallel to the central axis of the cap.

5. A combination according to claim 1, wherein the part of the shell carrying the wing is connected only to the other part of the shell along a boundary line.

6. A combination according to claim 1, wherein a lower boundary edge of the wing is profiled in such a manner that a part of the lower boundary edge extends over a curled portion of the can and wherein at least one other part of the boundary edge joining said part abuts against the outer circumference of the curled portion.

* * * * *